US006883884B2

(12) United States Patent
Chen et al.

(10) Patent No.: US 6,883,884 B2
(45) Date of Patent: Apr. 26, 2005

(54) LATCH ASSEMBLY FOR A TRACK DEVICE

(75) Inventors: Ken-Ching Chen, Kaohsiung Hsien (TW); Shih-Long Hwang, Kaohsiung Hsien (TW); Chun-Chiang Wang, Kaohsiung Hsien (TW); Jung-Pin Chen, Kaohsiung Hsien (TW); I-Ming Tseng, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 13 days.

(21) Appl. No.: 10/253,717

(22) Filed: Sep. 25, 2002

(65) Prior Publication Data

US 2004/0056572 A1 Mar. 25, 2004

(51) Int. Cl.[7] ..... A47B 88/00
(52) U.S. Cl. ..... 312/333; 312/334.44
(58) Field of Search ..... 312/330.1, 333, 312/334.1, 334.7, 334.44, 334.47, 332.1, 319.1

(56) References Cited

U.S. PATENT DOCUMENTS 3,589,778 A * 6/1971 Olson ..... 384/21
4,423,914 A * 1/1984 Vander Ley ..... 312/333
5,033,805 A * 7/1991 Hobbs ..... 312/334.11
6,238,031 B1 * 5/2001 Weng ..... 312/333
6,373,707 B1 * 4/2002 Hutchins ..... 361/725
2001/0035704 A1 * 11/2001 Dierbeck ..... 312/902

FOREIGN PATENT DOCUMENTS

FR 1331280 * 5/1963 ..... 312/333
GB 2028109 * 3/1980

* cited by examiner

*Primary Examiner*—James O. Hansen
(74) *Attorney, Agent, or Firm*—Bacon & Thomas PLLC

(57) ABSTRACT

A latch assembly is provided for a track device that includes a first track member and a second track member. The latch assembly comprises a latch handle mounted to the first track member and a latch seat provided on the second track member. The latch handle includes a latching portion and an unlatching member. The latching portion of the latch handle is releasably engaged with the latch seat, thereby preventing sliding movement of the first track member relative to the second track member. The unlatching member is operable to urge the latching portion to be disengaged from the latch seat, thereby allowing the sliding movement of the first track member relative to the second track member. Thus, the unlatching operation and pulling operation of a drawer plate to which the firs track member is mounted can be accomplished by only one hand.

26 Claims, 7 Drawing Sheets

LATCH ASSEMBLY FOR A TRACK DEVICE

BACKGROUND OF THE INVENTION

1. Field of the Invention

The present invention relates to a latch assembly for a track device for, e.g., a drawer of a computer desk or furniture.

2. Description of the Related Art

Typically, a latch device and a handle are mounted to different positions on a drawer of a computer desk or furniture. The manufacture cost is high, as many elements are involved. Further, both hands of the user are required when pulling out the drawer; namely, one for unlatching operation and the other for pulling out the drawer. Although connecting elements have been proposed to allow unlatching while pulling out the drawer, the cost is increased for the additional connecting elements.

SUMMARY OF THE INVENTION

It is the primary object of the present invention to provide a latch assembly for a track device attached to a drawer, allowing unlatching with one hand while pulling out the drawer. This object is achieved by providing a latch handle on the track device to thereby simplify the unlatching operation and allow easy operation.

It is another object of the present invention to provide a latch assembly for a track device attached to a drawer, the latch assembly including a latch handle and a latch seat that are mounted to the track device. Thus, the overall structure for the track device, the latch handle, and the latch seat is simplified.

In accordance with the present invention, a latch assembly is provided for a track device that includes a first track member fixed to, e.g., a drawer plate of furniture and a second track member fixed to, e.g., a wall of the furniture, the first track member being slidable relative to the second track member. The latch assembly comprises a latch handle mounted to the first track member and a latch seat provided on the second track member. The latch handle includes a latching portion and an unlatching member. The latching portion of the latch handle is releasably engaged with the latch seat, thereby preventing sliding movement of the first track member relative to the second track member. The unlatching member is operable to urge the latching portion to be disengaged from the latch seat, thereby allowing the sliding movement of the first track member relative to the second track member. Thus, by means of providing a latch handle on the first track member, the unlatching operation and pulling operation of the drawer plate is mounted can be accomplished by only one hand.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
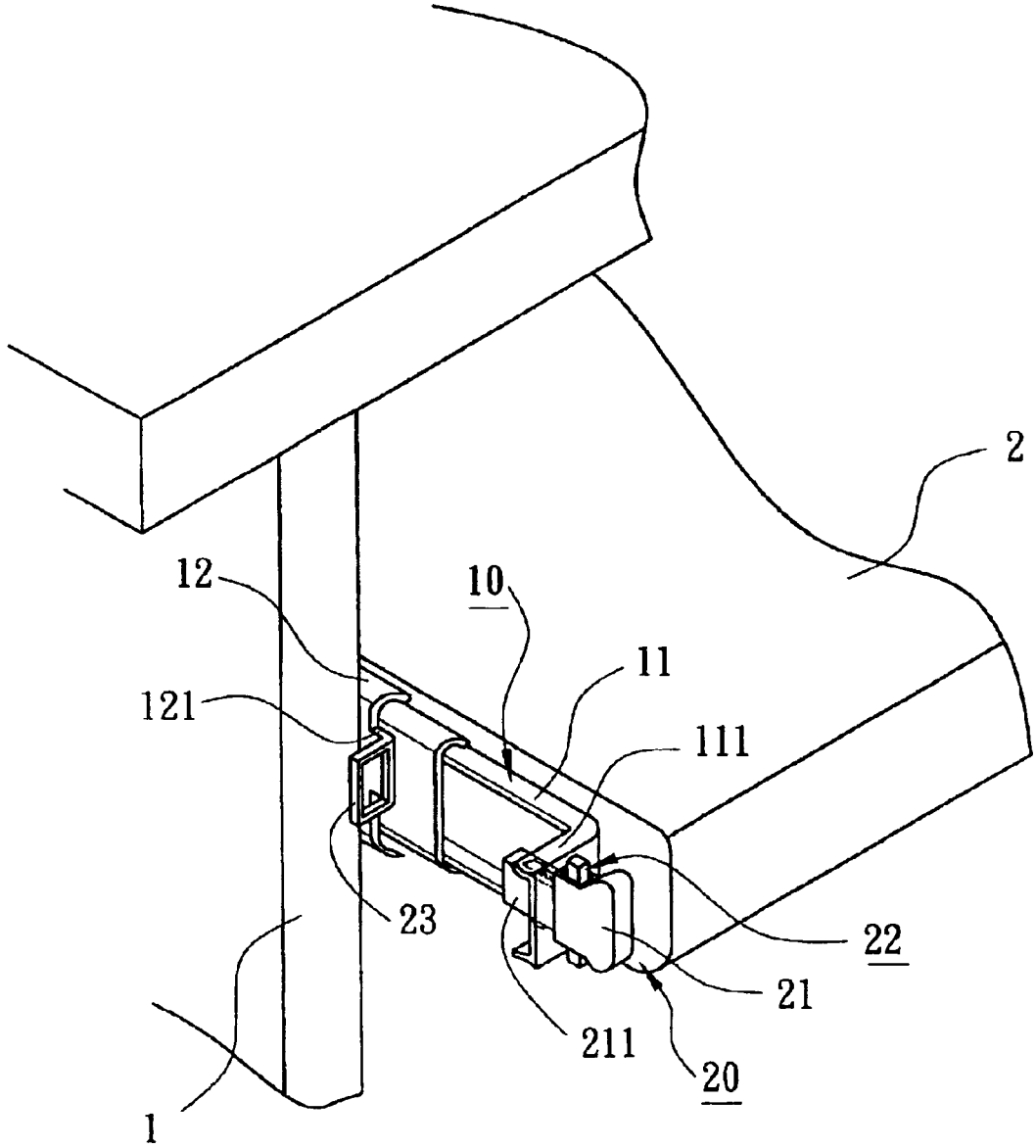
FIG. 1 is a perspective view of a computer desk equipped with a latch assembly for a track device in accordance with the present invention.

Referring to FIG. 1, a latch assembly in accordance with the present invention is mounted to a track device 10 for, e.g., a computer desk or furniture including a drawer plate 2 and a wall 1. The drawer plate 2 can be moved relative to the wall 1 along a horizontal direction.

Still referring to FIG. 1, the track device 10 includes a first track member 11 fixed to a side of the drawer plate 2, a first connecting portion 111 that is preferably integrally formed with the first track member 11, a second track member 12 fixed to the wall 1, and a second connecting portion 121 that is preferably formed with the second track member 12. In this embodiment, the first connecting portion 111 is an extension projecting from an outer end of the first track member 11 and extending in a direction perpendicular to a longitudinal direction of the first track member 11. The second connecting portion 121 is an extension extending from an outer end of the second track member 12.

Figure 2:
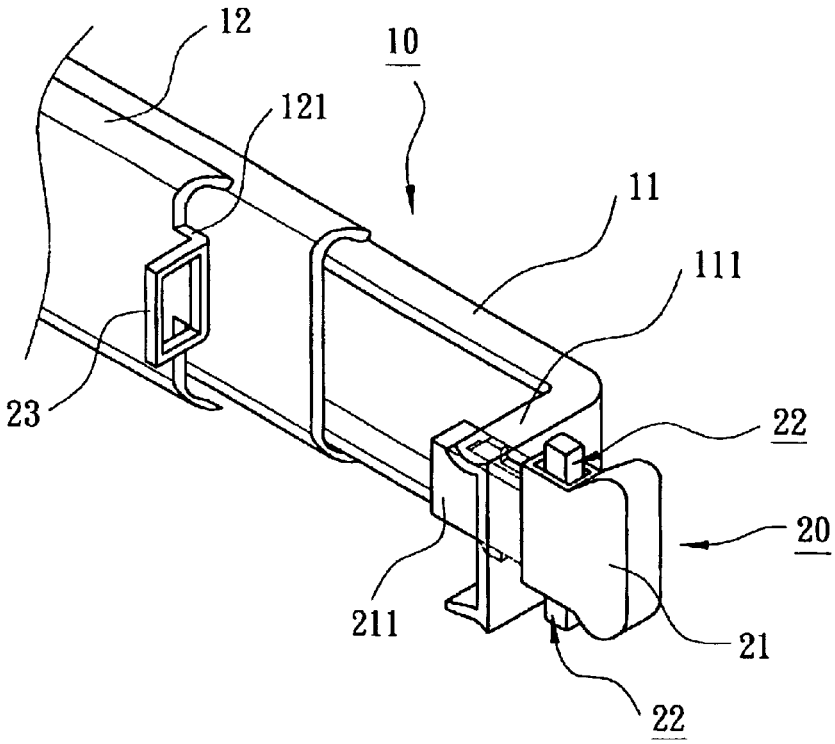
FIG. 2 is a partial perspective view of the track device and the latch assembly in FIG. 1.

Referring to FIG. 2, the latch assembly in accordance with the present invention is designated by reference numeral 20 and comprises a latch handle 21 mounted to the first connecting portion 111 and a latch seat 23 provided on the second connecting portion 121. Thus, the overall structure of the latch assembly is simplified. The latch handle 21 comprises a latching portion 211 for releasably engaging with the latch seat 23. As shown in at least FIG. 2, the latch seat 23 includes a bent ring member longitudinally aligned with the latching portion 211. The latch handle 21 further includes an unlatching means 22 that includes a pair of actuating members 223. Unlatching is effected when the actuating members 223 are pressed, and the user may pull the latch handle 21 to thereby pull out the first track member 11 and the drawer plate 2 or push the latch handle 21 to thereby push the first truck member 11 into the second track member 12.

Figure 3:
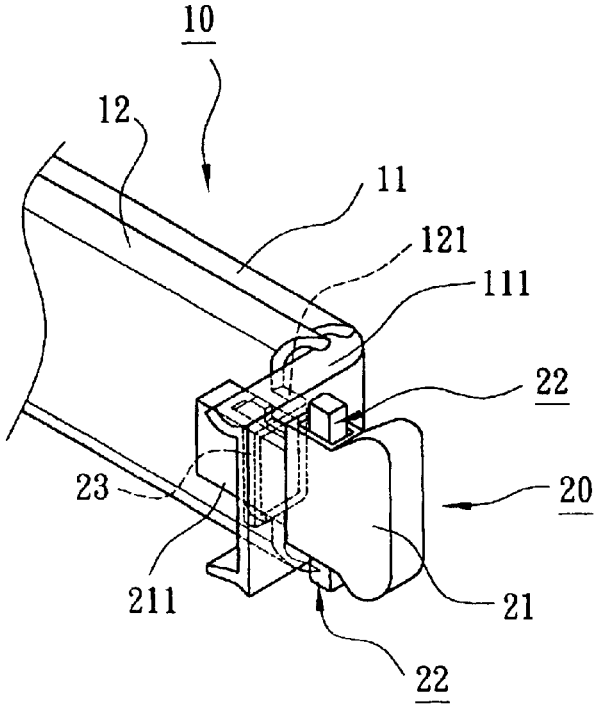
FIG. 3 is a view similar to FIG. 2, wherein the track device is in a latched position.

The track device in FIG. 2 is in an unlatched state and thus allows movement of the first track member 11 relative to the second track member 12. Namely, the drawer 2 is movable relative to the wall 1. Referring to FIG. 3, when the first track member 11 is retraced into the second track member 12 with the latching portion 211 being latched by the latch seat 23, the first track member 11 is not movable unless the actuating members 223 are pressed.

Figure 4:
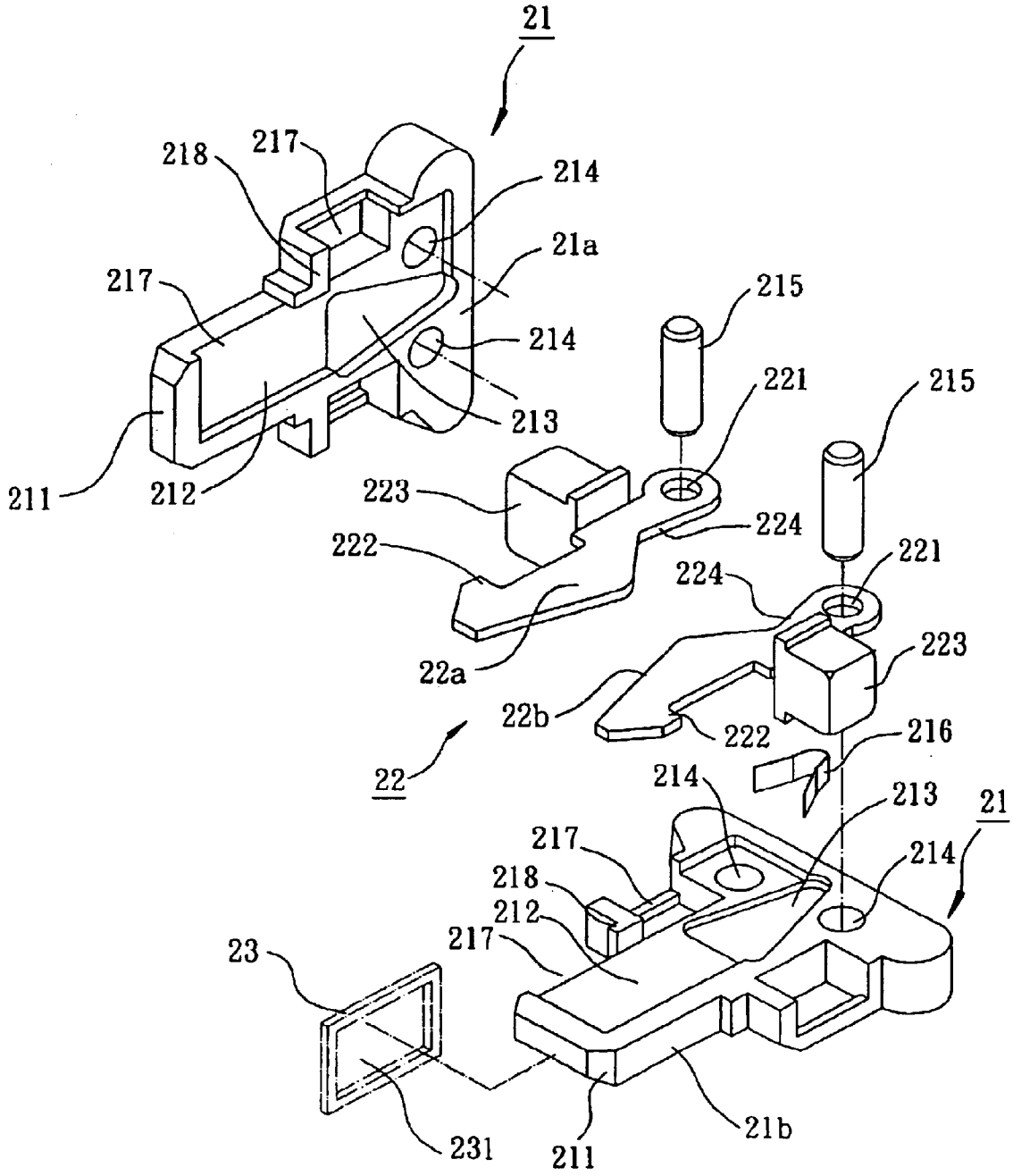
FIG. 4 is an exploded perspective view of the latch assembly in accordance with the present invention.

Referring to FIG. 4, in an embodiment of the invention, the latch handle 21 includes a casing consisting of two casing halves 21*a* and 21*b* that are symmetric to each other to allow easy manufacture and assembly. Each casing half 21*a*, 21*b* includes a compartment 212 for receiving the unlatching means 22. The compartment 212 has a recessed section 213 for receiving a return member 216 that can be compressed for subsequent returning operation. Further, each casing half 21*a*, 21*b* includes at least one hole 214 (two holes 214 in each casing half 21*a*, 21*b* in this embodiment) for receiving a pin 215. The holes 214 in the casing halves 21*a* and 21*b* are aligned with each other for respectively receiving two ends of the associated one of the pins 215. The compartment 212 in each casing half 21*a*, 21*b* is communicated with outside via an opening 217 in a side of the casing half 21*a*, 21*b*, and a restraining member 218 is provided adjacent to the opening 217 to allow partial extension of the unlatching means 22 out 11 of the casing 21*a*, 21*b*. When the casing halves 21*a* and 21*b* are engaged with each other, the openings 217 are located on two sides of the latch handle 21.

The unlatching means 22 further includes a first unlatching member 22*a* and a second unlatching member 22*b*. Each unlatching member 22*a*, 22*b* includes a hole 221 in an end thereof for pivotal connection with the associated pin 215, allowing the unlatching member 22*a*, 22*b* to pivot about the pin 215. Each unlatching member 22*a*, 22*b* further includes a hook 222 on the other end thereof. The hook 222 is normally exposed outside the latch handle 21 via the associated opening 217. The actuating members 223 are respectively mounted to two sides of the latch handle 21 for actuating the unlatching members 22*a* and 22*b*. When the respective pressing member 223 is pressed, it presses against the associated unlatching member 22*a*, 22*b* at a point adjacent to the end of the associated unlatching member 22*a*, 22*b*. Thus, the unlatching member 22*a*, 22*b* is pivoted about the pin 215 such that the hook 222 is moved into the latch handle 21. Each unlatching member 22*a*, 22*b* further includes an attaching section 224 that is opposite to the point where the associated actuating member 223 comes in contact with the unlatching member 22*a*, 22*b* during the unlatching operation. The return member 216 is an elastic element having two ends respectively attached to the attaching sections 224 of the unlatching members 22*a* and 22*b*. Thus, the unlatching members 22*a* and 22*b* are returned to their normal latching position under the action of the return member 216 when the actuating members 223 are released. Namely, the hooks 222 are moved out of the latch handle 21.

Figure 5:
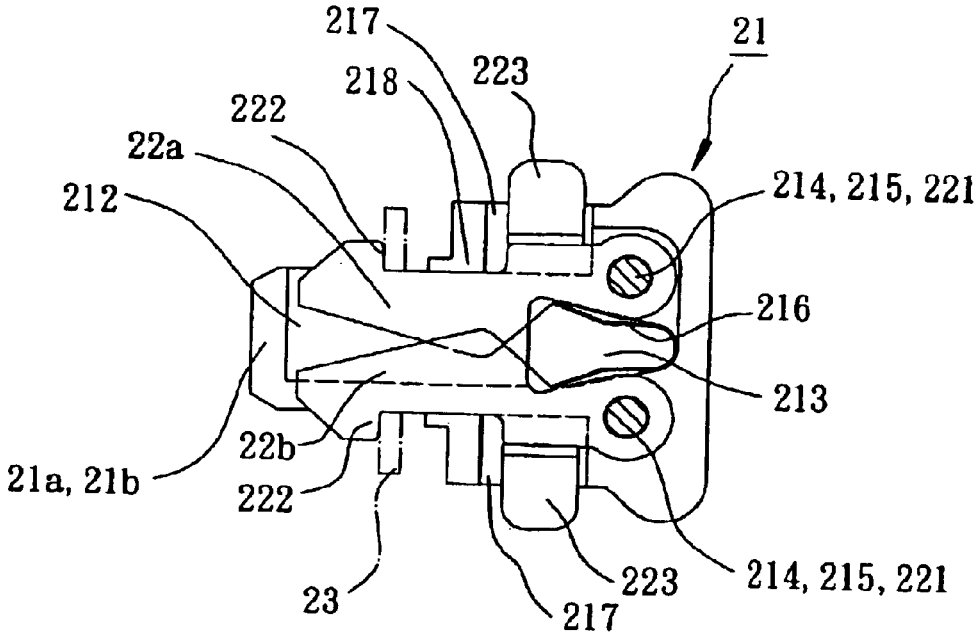
FIG. 5 is a sectional view of the latch assembly in a latched state.
Figure 6:
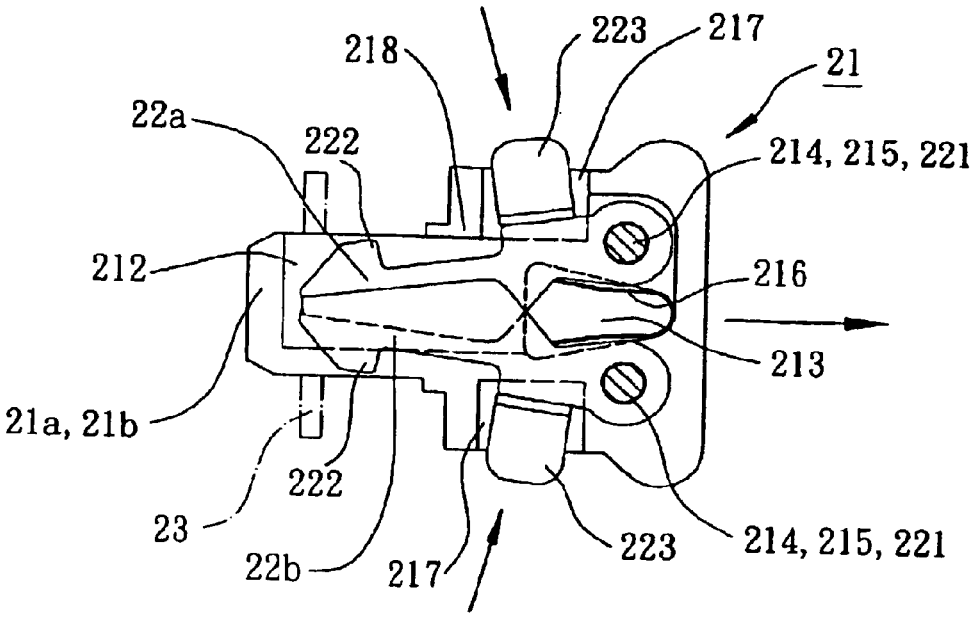
FIG. 6 is a view similar to FIG. 5, wherein the latch assembly is in an unlatched state.

The latch seat 23 includes a hole 231 through which the latching portion 211 of the latch handle 21 extends. When in the latched position, the hooks 222 of the unlatching members 22*a* and 22*b* are engaged with an end wall of the latch seat 23, preventing outward sliding movement of the first track member 11 relative to the second track member 12, best shown in FIG. 5. When the actuating members 223 are pressed, as shown in FIG. 6, in this unlatched position, the hooks 222 of the unlatching members 22*a* and 22*b* are moved into the latch handle 21 and thus disengaged from the end wall of the latch seat 23, allowing outward sliding movement of the first track member 11 relative to the second track member 12. Thus, by means of providing a latch handle 21 on the first track member 11, the unlatching operation and pulling operation of the drawer plate 2 can be accomplished by only one hand.

Figure 7:
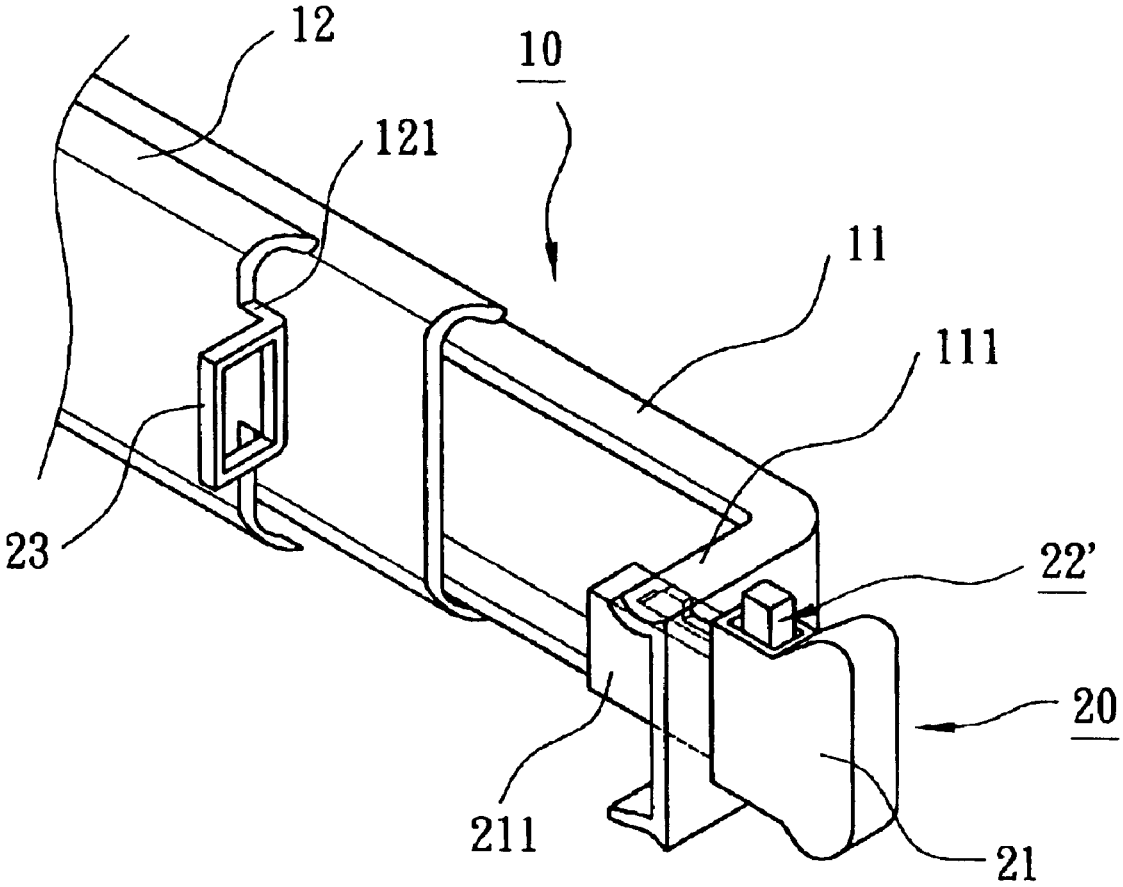
FIG. 7 is a partial perspective view illustrating a track and a modified embodiment of the latch assembly in accordance with the present invention.

FIG. 7 illustrates a modified embodiment of the latch assembly, wherein only one actuating member (now designated by 22') is used. The structure of the latch handle 21 is simplified.

Figure 8:
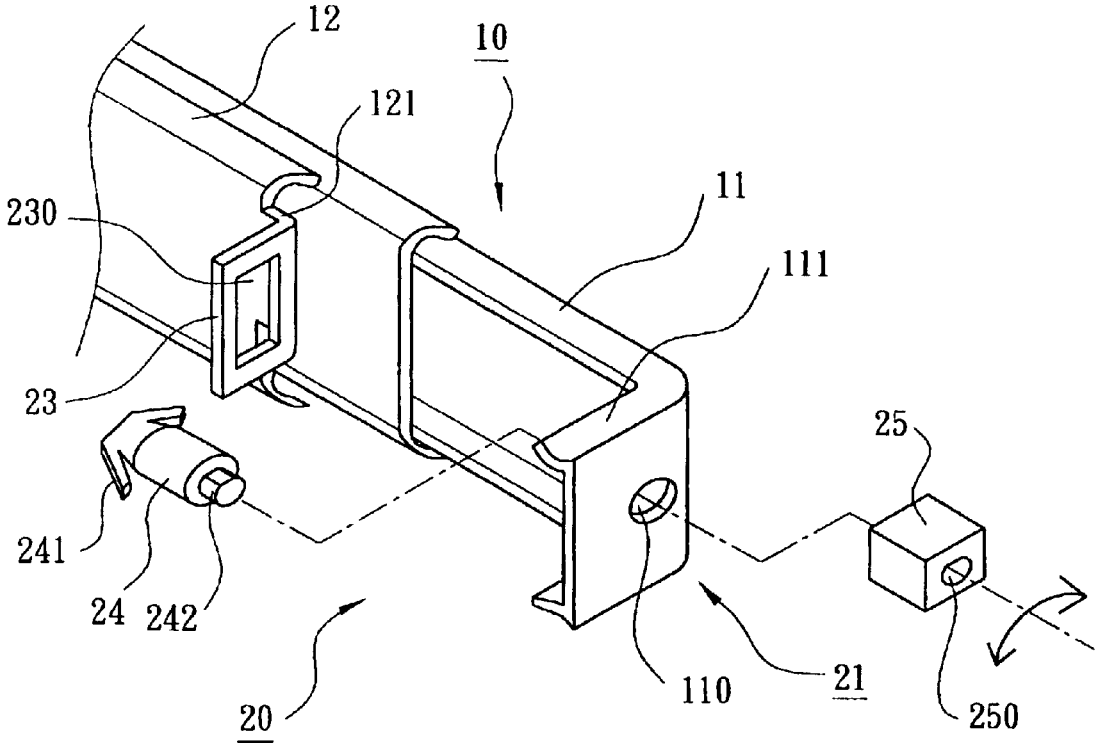
FIG. 8 is a partial perspective view, partly exploded, illustrating a track device and another modified embodiment of the latch assembly in accordance with the present invention.
Figure 9:
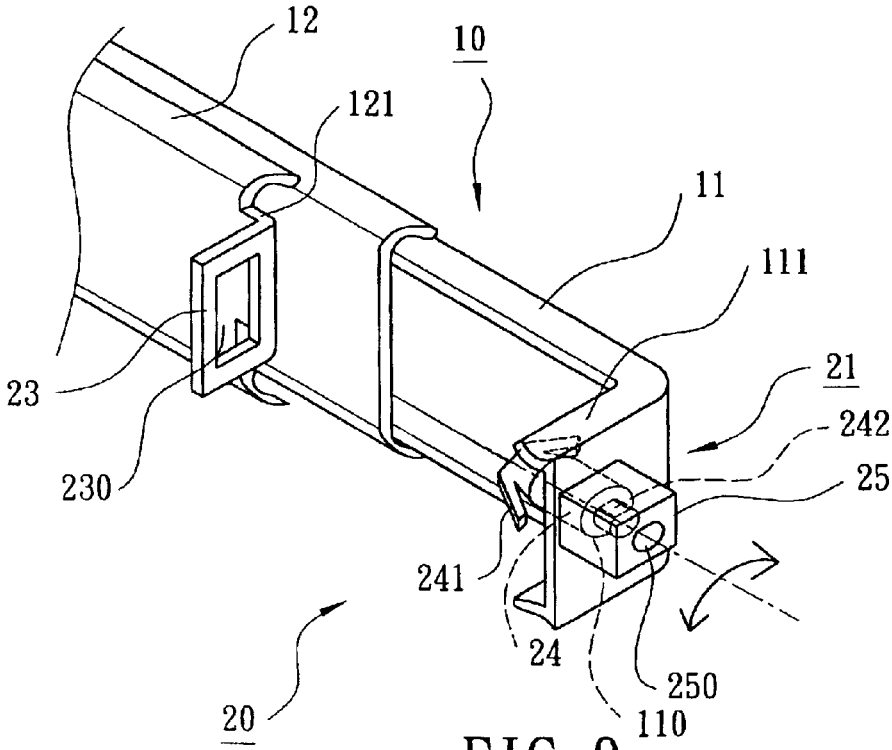
FIG. 9 is a partial perspective view of the track device and the modified embodiment in FIG. 8.

FIGS. 8 and 9 illustrate another embodiment of the latch assembly. In this embodiment, the latch assembly includes a latch handle 21 and a latch seat 23 provided on the second track member 12. The latch handle 21 includes a latch member (or latch portion) 24 and an unlatching member 25 in the form of a turn piece or turn knob. The latch member 24 includes a hook 241 on an end thereof for releasably engaging with the latch seat 23. The latch member 24 further includes a second end 242 having a non-circular section. The second end 242 rotatably extends through a hole 110 in the first connecting portion 111 and is then engaged with a non-circular hole 250 in the unlatching member 25. Thus, the unlatching member 25 may be turned between a latched position shown in FIG. 9 and an unlatched position (not shown). The latch seat 23 has a hole 230 having a width smaller than a maximum width of the hook 241. Further, the hole 230 of the latch seat 23 has a height greater than the maximum width of the hook 241. When in the latched position, since the width of the hook 241 of the latching member 24 is greater than that of the hole 230 of the latch seat 23, the first track member 11 cannot be moved away from the second track member 12. When in the unlatched position, the latching member 24 is turned to an upright position such that the width of the hook 241 is orientated in an upright position. Since the width of the hook 241 is smaller than the height of the hole 230 of the latch seat 23, the first track member 11 can be moved away from the second track member 12. Thus, a drawer plate to which the first track member 11 is fixed can be pulled out of e.g., a computer desk or furniture. Accordingly, one may grasp the unlatching member 25 and turn it through 90 degrees and then apply a force to pull the first track member 11 outward, best shown in FIG. 9.

Figure 10:
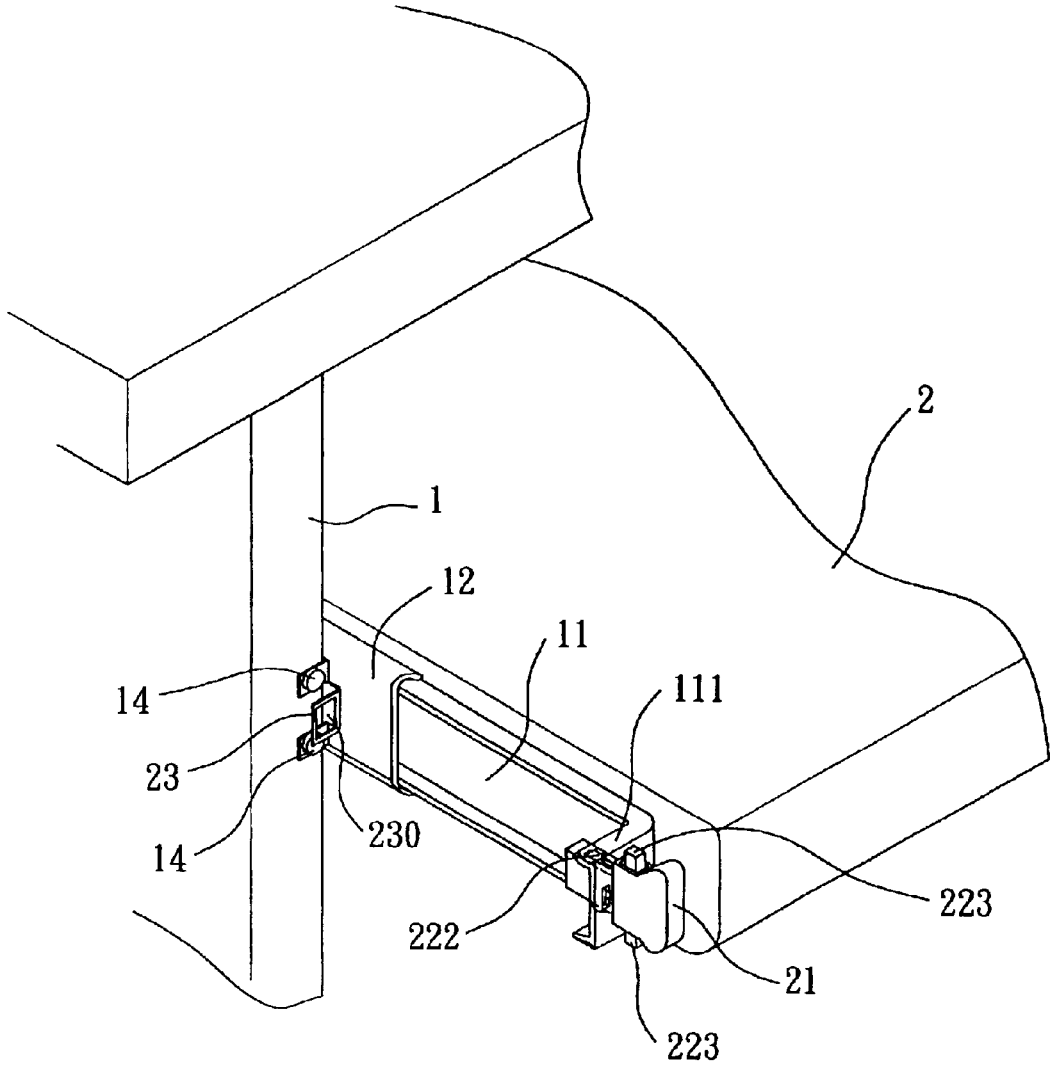
FIG. 10 is a perspective view f a computer desk equipped with a further modified embodiment of the latch assembly in accordance with the present invention.

FIG. 10 illustrates a further modified embodiment of the latch assembly for a track in accordance with the present invention, wherein the latch seat 23 is fixed to the wall 1 by fixing members 14, and the location of the latch handle 21 is correspondingly changed.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A latch assembly for a track device, the track device including a first track member and a second track member, the first track member being slidable relative to the second track member, the latch assembly comprising:

a latch handle mounted to the first track member, the latch handle including a latching portion and an unlatching member adapted to actuate the latching portion for releasing engagement; and a latch seat comprising a bent ring member longitudinally aligned with the latching portion of the latch handle and provided on the second track member, the latching portion of the latch handle being longitudinally extended through and releasably engaged with the bent ring member of the latch seat, thereby preventing longitudinally sliding movement of the first track member relative to the second track member, the unlatching member being operable to urge the latching portion to be disengaged from the bent ring member of the latch seat, thereby allowing the longitudinally sliding member of the first track member relative to the second track member, said unlatching member further includes an actuating member adapted to actuate the unlatching member to a position disengaged from the latch seat, and a return member adapted to return the unlatching member to its previous position.

2. The latch assembly for a track device as claimed in claim 1, wherein the first track member includes a first connecting portion to which the latch handle is mounted, the second track member including a second connecting portion from which the latch seat extends.

3. The latch assembly for a track device as claimed in claim 2, wherein the latching portion of the latch handle includes a first end having a hook and a second end rotatably extending through the first connecting portion of the first track member, the actuating member being securely attached to the second end of the latching portion of the latch handle, the latch seat including a hole, wherein when the actuating member is in a first position, the hook of the latching portion is not passable through the hole of the latch seat, thereby preventing the sliding movement of the first track member relative to the second track member, and wherein when the actuating member is turned to another position, the hook of the latching portion is moved to a position that allows passage of the hook through the hole of the latch seat, thereby allowing the sliding movement of the first track member relative to the second track member.

4. The latch assembly for a track device as claimed in claim 1, wherein the latch handle includes:

a casing defining a compartment therein, an opening being defined on a side of the casing and in communication with the compartment; and a pin mounted in the casing;

wherein the unlatching member having a first end pivotally attached to the pin and a second end with a hook, the hook being extended beyond the casing via the opening;

wherein the actuating member including a first end operably connected to the unlatching member and a second end outside the casing for manual pressing, the unlatching member being pivoted when the actuating member is pressed, thereby moving the hook of the unlatching member to a position disengaged from the latch seat; and wherein the return member mounted in the casing for returning the hook of the unlatching member to a position beyond the casing.

5. The latch assembly for a track device as claimed in claim 4, wherein the casing consists of two casing halves.

6. The latch assembly for a track device as claimed in claim 4, wherein the compartment of the casing includes a recessed section for receiving the return member.

7. The latch assembly for a track device as claimed in claim 4, wherein the casing includes a restraining member adjacent to the opening.

8. A latch assembly for a track device, the track device including a first track member and a second track member, the first track member being slidable relative to the second track member, the latch assembly comprising:

a latch handle mounted to the first track member, the latch handle including a latching portion and two unlatching members; and a latch seat provided on the second track member, the latching portion of the latch handle being releasably engaged with the latch seat, thereby preventing sliding movement of the first track member relative to the second track member, the unlatching member being operable to urge the latching portion to be disengaged from the latch seat, thereby allowing the sliding movement of the first track member relative to the second track member;

the latch handle including a casing defining a compartment therein, two openings being respectively defined in two sides of the casing and communicated with the compartment;

two pins mounted in the casing;

each of the unlatching members having a first end pivotally attached to an associated one of the pins and a second end with a hook, the hook being extended beyond the casing via an associated one of the openings;

two actuating members each including a first end operably connected to an associated one of the unlatching members and a second end outside the casing for manual pressing, the unlatching member being pivoted when the actuating member is pressed, thereby moving the hook of an associated one of the unlatching members to a position disengaged from the latch seat; and a return member mounted in the casing and attached between the actuating members for returning the hooks of the unlatching members to a position beyond the casing when the actuating members are released.

9. The latch assembly for a track device as claimed in claim 8, wherein the casing consists of two casing halves.

10. The latch assembly for a track device as claimed in claim 8, wherein the compartment of the casing includes a recessed section for receiving the return member.

11. A latch assembly for a track device for furniture, the furniture having a wall and a drawer plate, the track device including a first track member fixed to a side of the drawer plate and a second track member fixed to the wall of the furniture, the first track member being slidable relative to the second track member, thereby allowing sliding movement of the drawer plate relative to the wall of the furniture, the latch assembly comprising:

a latch handle mounted to the first track member, the latch handle including a latching portion and an unlatching member adapted to actuate the latching portion for releasing engagement; and a latch seat comprising a bent ring member longitudinally aligned with the latching portion of the latch handle and provided on one of the second track member and the wall of the furniture, the latching portion of the latch handle being longitudinally extended through and releasably engaged with the bent ring member of the latch seat, thereby preventing longitudinally sliding movement of the first track member relative to the second track member, the unlatching member being operable to urge the latching portion to be disengaged from the bent ring member of the latch seat, thereby allowing the longitudinally sliding movement of the first track member relative to the second track member; said unlatching member further includes an actuating member adapted to actuate the unlatching member to a position disengaged from the latch seat, and a return member adapted to return the unlatching member to its previous position.

12. The latch assembly for a track device for furniture as claimed in claim 11, wherein the first track member includes a first connecting portion to which the latch handle is mounted, the second track member including a second connecting portion from which the latch seat extends.

13. The latch assembly for a track device for furniture as claimed in claim 12, wherein the latching portion of the latch handle includes a first end having a hook and a second end rotatably extending through the first connecting portion of the first track member, the actuating member being securely attached to the second end of the latching portion of the latch handle, the latch seat including a hole, wherein when the actuating member is in a first position, the hook of the latching portion is not passable through the hole of the latch seat, thereby preventing the sliding movement of the first track member relative to the second track member, and wherein when the actuating member is turned to another position, the hook of the latching portion is moved to a position that allows passage of the hook through the hole of the latch seat, thereby allowing the sliding movement of the first track member relative to the second track member.

14. The latch assembly for a track device for furniture as claimed in claim 11, wherein the latch handle includes:

a casing defining a compartment therein, an opening being defined in a side of the casing and communicated with the compartment; and a pin mounted in the casing;

wherein the unlatching member having a first end pivotally attached to the pin and a second end with a hook, the hook being extended beyond the casing via the opening;

wherein the actuating member including a first end operably connected to the unlatching member and a second end outside the casing for manual pressing, the unlatching member being pivoted when the actuating member is pressed, thereby moving the hook of the unlatching member to a position disengaged from the latch seat; and wherein the return member mounted in the casing for returning the hook of the unlatching member to a position beyond the casing.

15. The latch assembly for a track device for furniture as claimed in claim 14, wherein the casing consists of two casing halves.

16. The latch assembly for a track device for furniture as claimed in claim 14, wherein the compartment of the casing includes a recessed section for receiving the return member.

17. The latch assembly for a track device for furniture as claimed in claim 14, wherein the casing includes a restraining member adjacent to the opening.

18. A latch assembly for a track device, the track device including a first track member and a second track member, the first track member being slidable relative to the second track member, the latch assembly comprising:

a latch handle mounted to the first track member, the latch handle including a latching portion and an unlatching member adapted to actuate the latching portion for releasing engagement; and a latch seat comprising a bent ring member longitudinally aligned with the latching portion of the latch handle and provided on the second track member, the latching portion of the latch handle being longitudinally extended through and releasably engaged with the bent ring member of the latch seat, thereby preventing longitudinally sliding movement of the first track member relative to the second track member, the unlatching member being operable to urge the latching portion to be disengaged from the bent ring member of the latch seat, thereby allowing the longitudinally sliding member of the first track member relative to the second track member:

wherein the latch handle includes:

a casing defining a compartment therein, an opening being defined on a side of the casing and in communication with the compartment;

a pin mounted in the casing:

the unlatching member having a first end pivotally attached to the pin and a second end with a hook, the hook being extended beyond the casing via the opening;

an actuating member including a first end operably connected to the unlatching member and a second end outside the casing for manual pressing, the unlatching member being pivoted when the actuating member is pressed, thereby moving the hook of the unlatching member to a position disengaged from the latch seat; and a return member mounted in the casing for returning the hook of the unlatching member to a position beyond the casing.

19. The latch assembly for a track device as claimed in claim 18, wherein the casing consists of two casing halves.

20. The latch assembly for a track device as claimed in claim 18, wherein the compartment of the casing includes a recessed section for receiving the return member.

21. The latch assembly for a track device as claimed in claim 18, wherein the casing includes a restraining member adjacent to the opening.

22. A latch assembly for a track device for furniture, the furniture having a wall and a drawer plate, the track device including a first track member fixed to a side of the drawer plate and a second track member fixed to the wall of the furniture, the first track member being slidable relative to the second track member, thereby allowing sliding movement of the drawer plate relative to the wall of the furniture, the latch assembly comprising:

a latch handle mounted to the first track member, the latch handle including a latching portion and an unlatching member adapted to actuate the latching portion for releasing engagement;

a latch seat comprising a bent ring member longitudinally aligned with the latching portion of the latch handle and provided on one of the second track member and the wall of the furniture, the latching portion of the latch handle being longitudinally extended through and releasably engaged with the bent ring member of the latch seat, thereby preventing longitudinally sliding movement of the first track member relative to the second track member, the unlatching member being operable to urge the latching portion to be disengaged from the bent ring member of the latch seat, thereby allowing the longitudinally sliding movement of the first track member relative to the second track member;

wherein the latch handle includes:

a casing defining a compartment therein, an opening being defined in a side of the casing and communicated with the compartment;

a pin mounted in the casing;

the unlatching member having a first end pivotally attached to the pin and a second end with a hook, the hook being extended beyond the casing via the opening;

an actuating member including a first end operably connected to the unlatching member and a second end outside the casing for manual pressing, the unlatching member being pivoted when the actuating member is pressed, thereby moving the hook of the unlatching member to a position disengaged from the latch seat; and a return member mounted in the casing for returning the hook of the unlatching member to a position beyond the casing.

23. The latch assembly for a track device for furniture as claimed in claim 22, wherein the casing consists of two casing halves.

24. The latch assembly for a track device for furniture as claimed in claim 22, wherein the compartment of the casing includes a recessed section for receiving the return member.

25. The latch assembly for a track device for furniture as claimed in claim 22, wherein the casing includes a restraining member adjacent to the opening.

26. A latch assembly for a track device for furniture, the furniture having a wall and a drawer plate, the track device including a first track member fixed to a side of the drawer plate and a second track member fixed to the wall of the furniture, the first track member being slidable relative to the second track member, thereby allowing sliding movement of the drawer plate relative to the wall of the furniture, the latch assembly comprising:

a latch handle mounted to the first track member, the latch handle including a latching portion and an unlatching member adapted to actuate the latching portion for releasing engagement; and a latch seat comprising a bent ring member longitudinally aligned with the latching portion of the latch handle and provided on one of the second track member and the wall of the furniture, the latching portion of the latch handle being longitudinally extended through and releasably engaged with the bent ring member of the latch seat, thereby preventing longitudinally sliding movement of the first track member relative to the second track member, the unlatching member being operable to urge the latching portion to be disengaged from the bent ring member of the latch seat, thereby allowing the longitudinally sliding movement of the first track member relative to the second track member;

wherein the first track member includes a first connecting portion to which the latch handle is mounted, the second track member including a second connecting portion from which the latch seat extends; and wherein the latching portion of the latch handle includes a first end having a hook and a second end rotatably extending through the first connecting portion of the first track member, the actuating member being securely attached to the second end of the latching portion of the latch handle, the latch seat including a hole, wherein when the actuating member is in a first position, the hook of the latching portion is not passable through the hole of the latch seat, thereby preventing the sliding movement of the first track member relative to the second track member, and wherein when the actuating member is turned to another position, the hook of the latching portion is moved to a position that allows passage of the hook through the hole of the latch seat, thereby allowing the sliding movement of the first track member relative to the second track member.

* * * * *